United States Patent [19]

Holcomb

[11] Patent Number: 4,659,161

[45] Date of Patent: Apr. 21, 1987

[54] ADAPTER PLUG FOR PERSONAL COMPUTERS

[76] Inventor: Kenneth L. Holcomb, 12386 S. Florence, Tulsa, Okla. 74037

[21] Appl. No.: 808,535

[22] Filed: Dec. 13, 1985

Related U.S. Application Data

[63] Continuation-in-part of Ser. No. 597,387, Apr. 6, 1984, abandoned.

[51] Int. Cl.[4] ..... H01R 13/68; H01R 13/70; H01R 13/717

[52] U.S. Cl. ..... 339/113 L; 339/147 R; 339/154 A; 339/159 R

[58] Field of Search ..... 339/154 R, 154 A, 156 R, 339/157 R, 157 C, 158, 159 R, 159 C, 166 R, 170, 147 R, 147 P, 113 R, 113 L; 340/638, 639

[56] References Cited

U.S. PATENT DOCUMENTS

| | | | |
|---|---|---|---|
| D. 64,594 | 5/1924 | Hubbell | 339/159 R |
| 1,716,834 | 6/1929 | Nichols | 339/159 R |
| 2,503,677 | 4/1950 | McHenry et al. | 339/113 R |
| 3,229,240 | 1/1966 | Harrison, Sr. et al. | 339/166 R |
| 3,646,499 | 2/1972 | De Lano et al. | 339/156 R |
| 3,924,914 | 12/1975 | Banner | 339/113 L |
| 4,239,319 | 12/1980 | Gladd et al. | 339/166 R |
| 4,403,111 | 9/1983 | Kelly | 339/156 R |

FOREIGN PATENT DOCUMENTS

| | | | |
|---|---|---|---|
| U 2430 | 3/1956 | Fed. Rep. of Germany | 339/166 R |
| 7503428 | 9/1976 | Netherlands | 340/638 |

*Primary Examiner*—John McQuade

*Attorney, Agent, or Firm*—Head, Johnson & Stevenson

[57] ABSTRACT

An adapter body for connection between an appliance, such as a personal computer, having a recessed male plug, comprising a body having a recessed male electrical connection and a boss portion forming a female electrical connection and a plurality of surface female plugs, the boss portion female plug being particularly configured for mating with the recessed male electrical plug of the appliance and the recessed male plug being configured to receive an extension cord plug, the surface female plugs being configured to receive the male plug portion of extension cords extending to other appliances, and voltage spike protectors within the adapter body with indicator lights to display the operability of the voltage spike protectors.

7 Claims, 7 Drawing Figures

ADAPTER PLUG FOR PERSONAL COMPUTERS

CROSS-REFERENCE

This is a continuation-in-part of application No. 597,387 entitled "Adapter Plug for IBM Personal Computers", filed Apr. 6, 1984, now abandoned.

SUMMARY OF THE INVENTION

This invention relates to an improved adapter plug body for use with an appliance, such as a personal computer, or other similar appliance having a recessed male plug therein adapted to receive the female plug and of an extension cord. Many appliances, and particularly personal computers, are the type which have a recessed male plug by which electrical power is fed from an extension cord having a female plug so that the extension cord may be removed from the appliance as necessary. Many such appliances, including specifically personal computers, require other power consuming devices to be operated in conjunction with them. As an example, the personal computer usually requires a printer, and a CRT, and sometimes other devices. The user must find some way to plug in these ancillary devices so that they can be supplied with power. If extension cords are run from each of these devices to a household or office electrical system this requires many cords extending from the apparatus.

The adapter plug of this invention is formed of an elongated body member having a front and rear surface. The front surface has a recess of cross-sectional shapes substantially identical to the recess in the appliance with which it is to be used. An electrically conductive male plug having prongs is received in the recess of shape and orientation substantially identical to the prongs in the recess in the appliance, the recess and the prongs being adaptable to receive the extension cord which normally is supplied with the appliance.

An integral boss portion extends from the body rear surface forming a female plug. The boss portion is of a cross-section configuration substantially identical to the recess in the appliance and has openings in the ends thereof to receive the prongs of the male plug recess in the appliance so that the boss portion may be plugged into the recess in the appliance and the body member thereby is removably supported to the appliance.

A number of surface plugs are formed in the body member front surface, the opening being arranged in a pattern to accept the metal prongs of ancillary extension cords. Each plug, whether male, female or surface plugs, includes an element providing a hot conductor, an element providing a neutral conductor and an element providing a ground conductor. Within the plug body are conductors interconnecting these elements. In the preferred arrangement a first conductor is retained within the body connecting the hot lugs of the plugs in parallel, a second conductor connects the neutral lugs of the plugs in parallel, and a third conductor connects the ground lugs of the plugs in parallel. A first fuse is connected to the first conductor. A first varistor is connected between the first fuse and the third conductor. A second fuse is connected to the second conductor and a second varistor connected between the second fuse and the third conductor. An indicator light is connected between the junction of the first fuse and first varistor and the junction of the second fuse and the second varistor.

A third fuse is connected to the second conductor and a third varistor is connected between the third fuse and the first conductor. An indicator light is connected between the junction of the third fuse and the third varistor and the first conductor.

The varistors function to bypass voltage spikes, that is, voltage above the preselected level of actuation of the varistor to thereby short voltage spikes and prevent the transmission of the voltage spikes to appliances connected to the adapter plug. If a voltage surge is sufficient to blow one of the three fuses, and thereby take at least one spike protecting varistor out of the circuit, an indicator light does not light when the plug adapter is energized, thus advising the user that spike protection is not available. This circuit arrangement protects spikes appearing between the hot wire and ground, the hot wire and neutral or between the ground and neutral so that all three possibilities of a spike voltage developing are protected by the varistors. The two indicating lights serve to signal when all or a portion of the spike protection features of the circuit are not operable.

With reference to other plug-type devices the following U.S. Pats. Nos. are deemed to indicate the state of the prior art: 3,242,455; 3,439,308; 3,484,735; 3,579,175; 3,629,789; 3,229,240; 4,239,319; 3,646,499; 1,716,834; Des. 64,594; 4,403,111; and German Pat. No. 42430.

A better understanding of the invention will be had by reference to the following specification and claims, taken in conjunction with the attached drawing.

DETAILED DESCRIPTION OF PREFERRED EMBODIMENT

Figures 1, 2, 3:
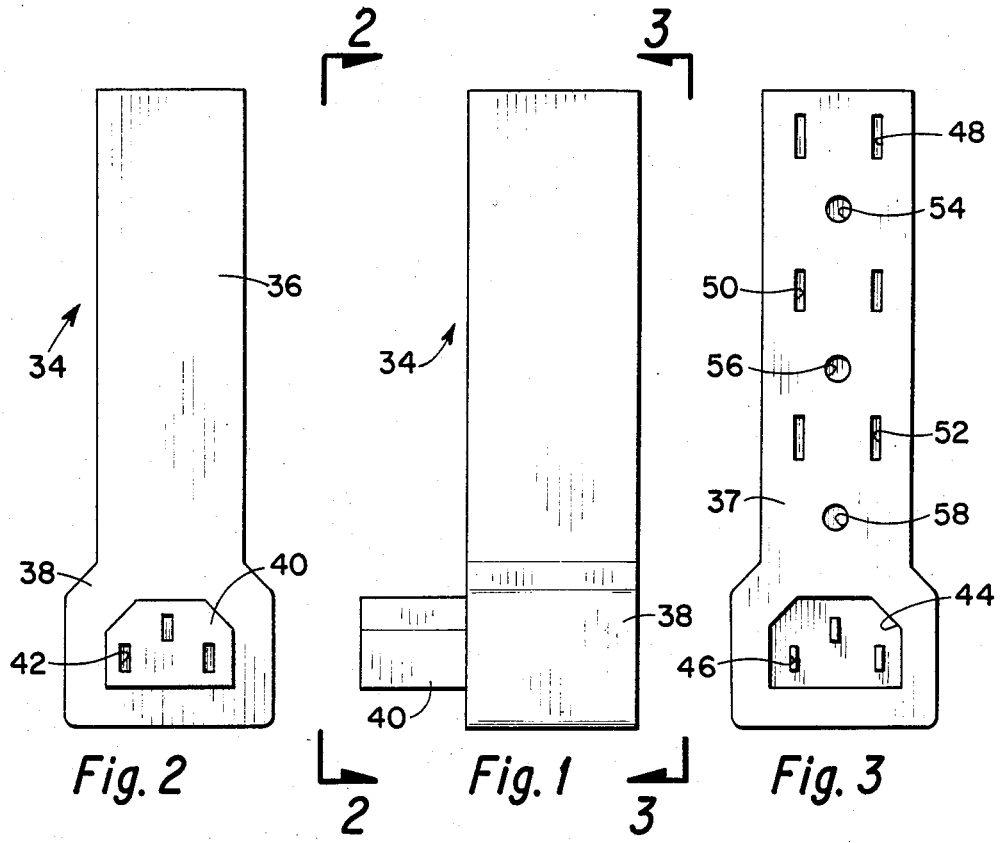
FIG. 1 is a side elevational view of an adapter plug according to the present invention.
FIG. 2 is a view taken along the line 2—2 of FIG. 1.
FIG. 3 is a view taken along the line 3—3 of FIG. 1.

Referring now to FIGS. 1 through 3, references character 34 generally indicates an adapter plug comprising an elongated body 36 constructed from non-conductive material and having an enlarged portion 38 provided at one end thereof. A boss portion 40 extends substantially perpendicularly outwardly from one face of the enlarged portion 38, and is preferably molded integrally therewith. A plurality of spaced substantially mutually parallel bores 42 are provided in the boss portion 40 and are spaced in accordance with the spacing of the electrical connectors of the power-in plug means of the usual personal computer or other appliance for receiving the electrical connectors therein. The bores 42 are provided with the usual conductor elements or lugs therein.

Figure 5:
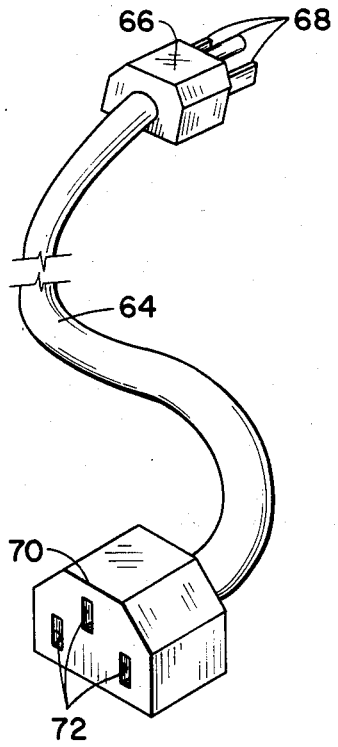
FIG. 5 is an isometric view of a typical extension cord by which an appliance is supplied with electrical energy and for which the adapter plug of this invention may be used.

The opposite face of the enlarged portion 38 is provided with a recess 44 extending therein and a plurality of prongs or electrical connectors or lugs 46 having one end of each secured in the enlarged portion 38 and the opposite ends extending into the recess 44 providing a male electrical connection for compatibility with an extension cord, such as seen in FIG. 5.

A plurality of complementary pairs of spaced bores 48, 50 and 52 forming surface plugs are provided in the elongated body 36 and are open at the same side or face thereof as the recess 44 as particularly shown in FIG. 3. Each pair of bores 48, 50 and 52 is provided with a corresponding bore 54, 56 and 58, respectively, also open to the same side or face of the body 26 as the recess 44. Each pair of bores 48, 50 and 52 cooperates with the respective bore 54, 56 and 58 for receiving the prongs or male electrical connectors and the ground plug of suitable plug means such as the male plug end of the extension cord of FIG. 5, so that auxiliary equipment can be operably connected with electrical power. Suitable electrical power connectors are provided within the body 36 and enlarged portion 38 for providing connection between the bores 42 and the bores 48, 50 and 52 and between the prongs 46 and the bores 48, 50 and 52.

In use the adapter 34 may be connected with the usual power-in connection of the normal extension cord, such as that of FIG. 5, by connecting the normal male electrical connectors of the appliance with the bores 42 of the adapter 34. The rear surface 36 of the body has portion 40 extending therefrom and the front side 37 has recess 44 and the surface place thereon.

Figure 6:
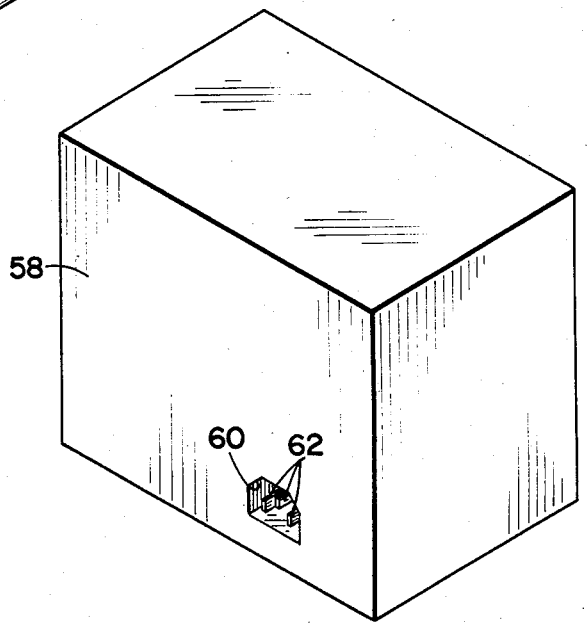
FIG. 6 is an isometric view of the rear portion of a typical appliance showing a recessed male plug of the type with which the present invention may be used.

FIG. 6 shows a typical appliance 58, such as a personal computer, which has a recess 60 therein with male lugs 62. This is the standard type of recess by which most appliances, including personal computers, are supplied with electrical energy by means of an extension cord such as shown in FIG. 5. The extension cord includes a conductor portion 64 and the typical male plug portion 66 having lugs 68 which are readily connected with the typical electrical outlet in a home or office. The female plug portion 70 has the female lugs 72 to connect with an appliance and is configured to be received in recess 60 of appliance 58 and when extended into such recess the female lugs 72 receive the male lugs 62.

In the application of the present invention the adapter boss portion 40 is inserted into recess 60 and the extension cord female plug portion 70 is inserted into the recess 44 in the adapter so that electrical continuity is applied to the appliance 58 and at the same time electrical continuity is provided with surface plugs available for connecting ancillary appliances such as printers, CRT's etc. These are represented by the lugs 48 through 58 of FIG. 3.

Figure 4:
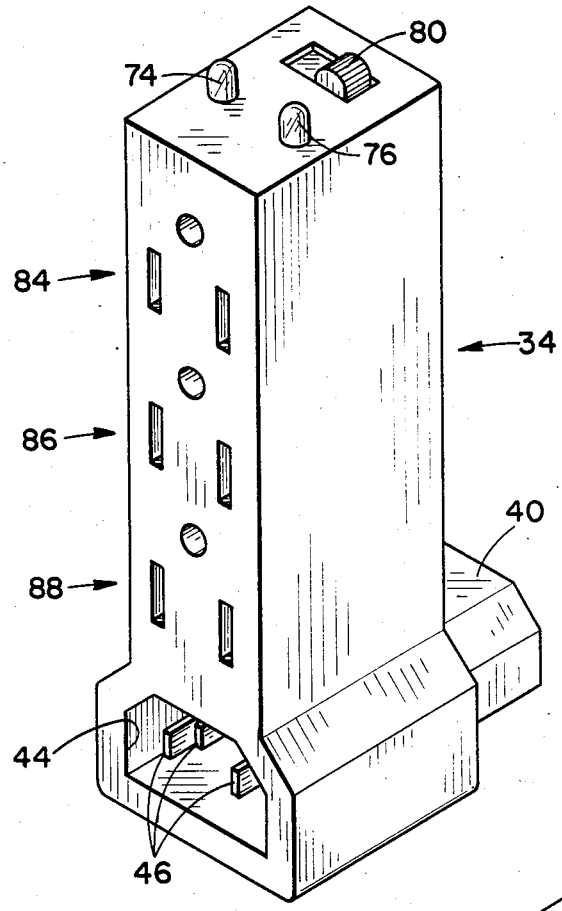
FIG. 4 is an isometric view of the adapter plug of this invention showing an alternate embodiment including indicator lights for indicating the operability of voltage spike protection systems within the adapter plug.

FIG. 4 shows an alternate embodiment of the invention which, on the external surface, is different in appearance from that of FIGS. 1 through 3 by the provision of indicator lights 74 and 76 and switch 80 which will be described with reference to the circuit arrangement of FIG. 7 which shows the circuit internally of the adapter of FIG. 4.

Figure 7:
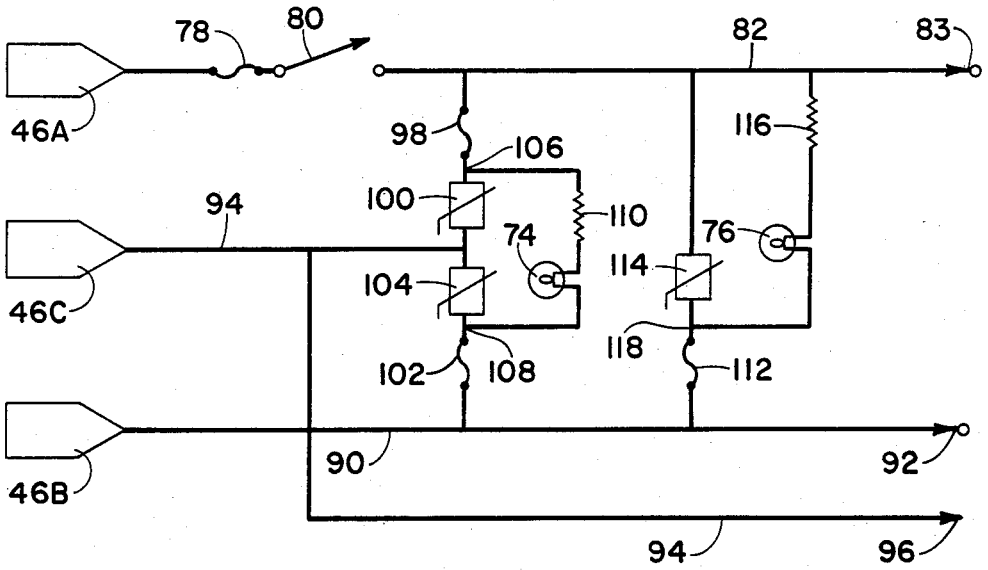
FIG. 7 is a circuit diagram of the embodiment of the invention shown in FIG. 4.

Referring to FIG. 7, the male lugs which receive connection to a source of electrical energy, such as by means of the extension cord of FIG. 5, are indicated by a hot lug 46A, a neutral lug 46B and a ground lug 46C of the type wherein 120 volts is normally supplied utilizing a hot conductor, a neutral conductor and a ground conductor. In series with the hot lug 46A is a main fuse 78. When this fuse is employed in the circuit internally of the adapter 34 electrical energy will be applied to the female plug 62 of the appliance and to the surface plugs only when fuse 78 is conductive, that is, not blown. If an overload occurs either in the appliance 58 or in any appliance connected by means of the surface plugs, the fuse will blow thereby protecting the adapter 34, the extension cord as shown in FIG. 5, and the building wiring from overload.

A switch 80 may be employed to function as a master switch so that if switch 80 is in the open or off position, as indicated in FIG. 7, neither the appliance 58 nor any appliance plugged into the surface plugs will be energized. The switch 58 is shown on the top of the adapter body 34 and is shown as a slide switch although it can be a toggle switch or any other kind of switch as desired.

The first lug 46A is connected by fuse 78 and switch 80 to a first conductor 82 which extends to arrow 83 which connects with a female lug in the female plug of extending portion 40 and to the surface plugs indicated by the numerals 84, 86 and 88 of FIG. 4, there being three such surface plugs available on the illustrated embodiment. In like manner, a second conductor 90 within the adapter body extends from neutral lug 46B to arrow 92 which connects to the neutral lug of the female plugs. A third conductor 94 connects the ground lug 46C to the other female plugs as indicated by arrow 96.

A serious problem with some appliances, such as computers, is the disruption of the performance of the appliance when voltage spikes occur. The adapter of FIG. 4, which houses the circuit arrangement of FIG. 7, provides a means of arresting voltage spikes and for this purpose includes, as indicated in FIG. 7, a first fuse 98 connected to first conductor 82. A first varistor 100 is connected between fuse 98 and third or ground conductor 94. In like manner, a second fuse 102 is connected to second conductor 90. A second varistor 104 is connected between fuse 102 and the ground conductor 94. Intermediate first fuse 98 and first varistor 100 is a junction 106 and intermediate the second fuse 102 and second varistor 104 is a junction 108. An indicator light 74 is connected between junctions 102 and 108 with a resistor 110 in series with the light 74 to adjust the voltage to that of the light filament.

A third fuse 112 is connected to second conductor 90 and from fuse 112 a third varistor 114 is connected to the first conductor 82. Between fuse 112 and 114 is a junction 118. Indicator light 76 is connected between junction 118 and conductor 82 with a resistor 116 in series with the light 76 to adjust the voltage thereacross for the light filament.

Varistors 100, 104, and 114 are metal oxide varistors, such as zinc oxide varistors, which are voltage dependent symmetrical resistors which perform similarly to back-to-back zenor diodes. When exposed to high energy voltage transients, varistors 100, 104 and 114 change impedance from a very high stand-by value to a very low conductive value, thus clamping the transient to a protective level. The energy of the incoming high voltage pulse or spike is absorbed by the varistors, protecting the voltage sensitive components, such as appliance 58, and other appliances connected to the adapter.

If a high voltage surge appears with sufficient current, any one of the varistors 100, 104 or 114 may explode. Therefore, to protect the varistors and prevent them from exploding, fuses 98, 102 and 112 are employed. Fuses should be sized, such as approximately six amps., so as to protect the varistors. If either fuse 98 or 102 blows, voltage to indicator light 74 is eliminated, thus the light 74 will not burn when the adapter is plugged to a source of electrical energy. The same applies to fuse 112. If it blows adapter light 76 will not luminate. Fuses 98, 102 and 112 do not interfere with voltage to the appliances but when one of these fuses blows an indication is given that the adapter is no longer providing spike protection. Thus, when the user plugs power into the adapter, or turns on switch 80, the illumination of indicator lights 74 and 76 indicate that the adapter is providing spike protection. When either one of the indicator lights is blown, a portion of the spike protection supplied by the adaper is decreased. It can be seen that the most important spike protection is applied between the hot or first conductor 82 and the neutral or second conductor 90. Thus, the operator may elect to continue to use the apparatus if indicator light 74 is blown, as long as the indicator light 76 is still ignited. However, if the user is abundantly precautious against the consequences of voltage spikes then the user will discontinue using the adapter when either light 74 or 76 is not illuminated.

The invention thus provides a unique device for supplying power to an appliance, such as a personal computer, and to ancillary equipment including printers and CRT's. In the embodiment of the invention as shown in FIG. 4 and 7, the adapter provides spike protection and indication to the operator that the spike protection system is functional. Further, switch 80 provides a means of turning off all of the appliances, including the one into which the adapter is inserted, and the appliances connected to the adapter by supplemental extension cord. The master or main fuse 78 provides protection to the adapter and extension cords and building wiring if an overload occurs in any of the appliances receiving electrical energy by way of the adapter.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. An electrical adapter for a small appliance having a recess in one wall thereof, the recess being of a preselected cross-sectional configuration and having a plurality of metal prongs in the recess by which power is supplied to the appliance as by means of an extension cord, the extension cord having a female end thereon configured of mating cross-sectional configuration to be inserted into said recess and having openings in the end thereof to receive the prongs, the openings in the extension cord male end having conductive members therein connected to wires which extend to a source of electrical energy whereby electrical energy is normally supplied to the appliance by the extension cord, the electrical adapter providing means of using the extension cord for supplying electrical energy to the appliance and at the same time provide receptacles for receiving a plurality of other extension cords by which ancillary equipment may be supplied with electrical energy, the electrical adapter comprising:

an elongated body member having, parallel to the body longitudinal axis, a front surface and a rear surface, the front surface having therein a recess of cross-sectional shape substantially identical to the recess in the appliance;

an electrically conductive male plug having prongs received in said recess of shape and orientation substantially identical to the prongs in the recess in the appliance, the recess and prongs being adaptable to receiving an extension cord female end;

an integral boss portion extending from said body rear surface forming a female plug, the boss portion being of cross-sectional configuration substantially identical to the recess in the appliance and having openings in the end thereof to receive the prongs in the male plug recess in the appliance whereby the boss portion may be plugged into the recess in the appliance and said body member being thereby removably supported to the appliance;

a plurality of spaced part openings in said body member front surface forming surface plugs, the openings being arranged in patterns to accept the metal prongs of ancillary extension cords, each opening having means to provide electrical continuity with a prong received therein, and the prongs and conductive members in said body member being electrically interconnected for providing electrical power transfer therebetween.

2. An electrical adapter according to claim 1 wherein said male, female and surface plugs each have a hot lug, a neutral lug and a ground lug, and wherein said conductive members in said body include:

first conductor means within said body connecting said hot lugs of said plugs in parallel;

second conductor means within said body connecting said neutral lugs of said plugs in parallel;

third conductor means within said body connecting said ground lugs of said plugs in parallel;

a first fuse connected to said first conductor means;

a first varistor connected between said first fuse and said third conductor means;

a second fuse connected to said second conductor means;

a second varistor connected between said second fuse and said third conductor means;

an indicator light connected between the junction of said first fuse and first varistor and the junction of said second fuse and said second varistor;

a third fuse connected to said second conductor means;

a third varistor connected between said third fuse and said first conductor means; and an indicator light connected between the junction of said third fuse and third varistor and said first conductor means.

3. An electrical adapter according to claim 2 including:

a switch supported by said body and manually operable exteriorally of said body, the switch being in electrical series between said first conductor means and said hot lug of said male plug.

4. An electrical adapter according to claim 3 including:

a fuse contained within said body and in electrical series between said switch and said first conductor means.

5. A plug for an electrical device providing protection from voltage spikes, comprising;

a non-conductive body having a male plug, a female plug, and at least one surface plug, each of said plugs having a hot lug, a neutral lug and a ground lug;

first conductor means within said body connecting said hot lugs ofsaid plugs in parallel;

second conductor means within said body connecting said neutrallugs of said plugs in parallel;

third conductor means within said body connecting said ground lugs of said plugs in parallel;

a first fuse connected to said first conductor means;

a first varistor connected between said first fuse and said third conductor means;

a second fuse connected to said second conductor means;

a second varistor connected between said second fuse and said third conductor means;

an indicator light connected between the junction of said first fuse and first varistor and the junction of said second fuse and said second varistor;

a third fuse connected to said second conductor means;

a third varistor connected between said third fuse and said first conductor means; and an indicator light connected between the junction of said third fuse and third varistor and said first conductor means.

6. A plug for an electrical device according to claim 5 including:

a switch supported by said body and manually operable exteriorally of said body, the switch being in electrical series between said first conductor means and said hot lug of said male plug.

7. A plug for an electrical device according to claim 6 including:

a fuse contained within said body and in electrical series between said switch and said first conductor means.

* * * * *